US011519213B2

(12) United States Patent
Contreras et al.

(10) Patent No.: US 11,519,213 B2
(45) Date of Patent: Dec. 6, 2022

(54) AUTOMATED DOOR ASSEMBLY FOR A DISHWASHER APPLIANCE

(71) Applicant: Haier US Appliance Solutions, Inc., Wilmington, DE (US)

(72) Inventors: Maria Alejandra Contreras, Lousiville, KY (US); Nurein Ibrahim Ahmed, Louisville, KY (US); Nasib AlHaffar, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 441 days.

(21) Appl. No.: 16/669,874

(22) Filed: Oct. 31, 2019

(65) Prior Publication Data

US 2021/0131161 A1 May 6, 2021

(51) Int. Cl.

| | |
|---|---|
| ***E05F 15/63*** | (2015.01) |
| ***A47L 15/42*** | (2006.01) |
| ***E05F 15/70*** | (2015.01) |
| ***E05B 17/00*** | (2006.01) |

(52) U.S. Cl.

CPC ..... *E05F 15/63* (2015.01); *A47L 15/4259* (2013.01); *A47L 15/4261* (2013.01); *E05B 17/0029* (2013.01); *E05F 15/70* (2015.01); *A47L 2501/22* (2013.01); *E05Y 2201/422* (2013.01); *E05Y 2900/304* (2013.01)

(58) Field of Classification Search

None

See application file for complete search history.

(56) References Cited

U.S. PATENT DOCUMENTS

| | | | |
|---|---|---|---|
| 4,951,693 | A | 8/1990 | Archambault |
| 7,731,806 | B2 | 6/2010 | Hapke |
| 8,882,933 | B2 | 11/2014 | Assmann |
| 8,905,494 | B2 | 12/2014 | Kilic |
| 9,084,526 | B2 | 7/2015 | Assmann et al. |
| 10,140,072 | B2 | 11/2018 | Chang et al. |
| 2016/0130854 | A1* | 5/2016 | Carli ..... F16H 19/04 74/32 |

FOREIGN PATENT DOCUMENTS

| | | | |
|---|---|---|---|
| CN | 108542332 | A | 9/2018 |
| KR | 100413622 | B1 | 12/2003 |
| WO | WO2019076636 | A1 | 4/2019 |

* cited by examiner

*Primary Examiner* — Rita P Adhlakha

(74) *Attorney, Agent, or Firm* — Dority & Manning, P.A.

(57) ABSTRACT

An automated door assembly for a dishwasher appliance includes a door frame pivotally mounted to the cabinet. An extension arm is mounted to and extends away from the door frame at approximately 90 degrees. A motor is mounted to the cabinet and is coupled to a distal end of the extension arm by a cable. The motor is selectively rotated to wind and unwind the cable to move the door frame between the closed position and the open position. A latch assembly engages a striker mounted on the door frame to initiate the opening and closing process.

14 Claims, 6 Drawing Sheets

AUTOMATED DOOR ASSEMBLY FOR A DISHWASHER APPLIANCE

FIELD OF THE INVENTION

The present subject matter relates generally to door assemblies for appliances, and more particularly to a hands-free, automated door assembly for a dishwasher appliance.

BACKGROUND OF THE INVENTION

Dishwasher appliances generally include a tub that defines a wash chamber. Rack assemblies can be mounted within the wash chamber of the tub for receipt of articles for washing. Multiple spray assemblies can be positioned within the wash chamber for applying or directing wash fluid towards articles disposed within the rack assemblies in order to clean such articles. Dishwasher appliances are also typically equipped with at least one pump for circulating fluid through the multiple spray assemblies. In addition, devices referred to as diverters may be used to control the flow of fluid received from the pump.

In order to provide access to the wash chamber and to contain the spray of wash fluid during a wash or rinse cycle, dishwasher appliances further include a door that is typically pivotally mounted to a bottom of the tub. A latch mechanism is typically positioned at a top of the door and is configured for locking the door in the closed position during an operating cycle. Notably, however, such a latch mechanism requires a user to manually engage and disengage the door, e.g., by pulling or pushing the door handle. Moreover, even when unlatched, the process of pivoting the door between the open and closed positions is entirely unregulated, relying on gravity to open the door and user intervention to close the door.

Accordingly, a dishwasher appliance that utilizes an improved door assembly would be useful. More specifically, an automated door assembly that facilitates a hands-free opening and closing process for a dishwasher appliance would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dishwasher appliance defining a vertical, a lateral, and a transverse direction is provided. The dishwasher appliance includes a cabinet and a tub positioned within the cabinet, the tub defining a wash chamber for receipt of articles for washing. A door assembly provides selective access to the wash chamber and includes a door frame pivotally mounted to the cabinet, an extension arm mounted to and extending away from the door frame, and a motor operably coupled to the extension arm for moving the door frame between an open position and a closed position.

In another exemplary aspect of the present disclosure, an automated door assembly for a dishwasher appliance is provided. The dishwasher appliance includes a tub positioned within a cabinet and defining a wash chamber. The automated door assembly includes a door frame pivotally mounted to the cabinet, an extension arm mounted to and extending away from the door frame, a motor mounted within the cabinet for selectively rotating a drive pulley, and a cable wrapped around the drive pulley and being connected to a distal end of the extension arm, the motor being configured for selectively winding the cable to move the door frame to a closed position and unwinding the cable to move the door frame to an open position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
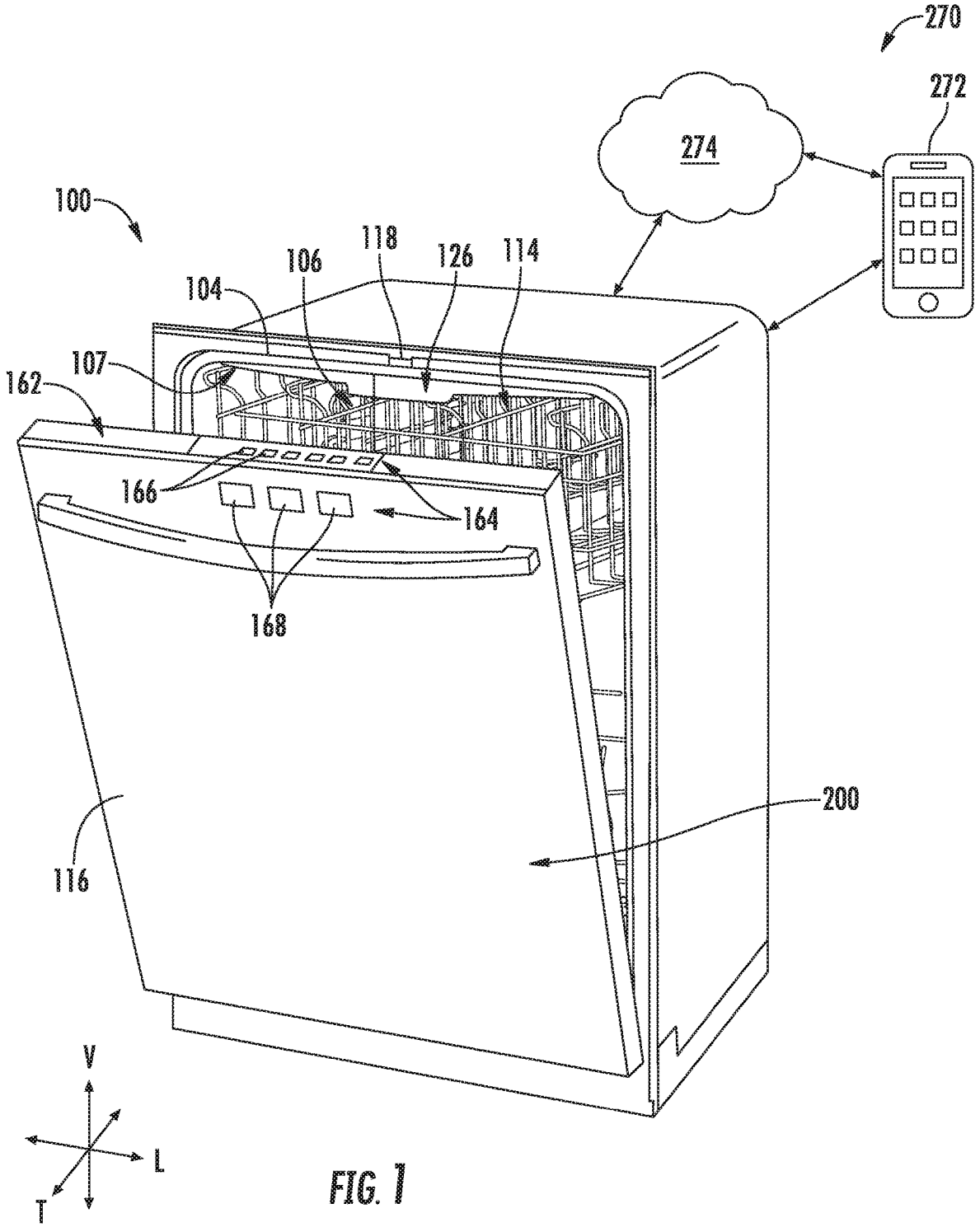
FIG. 1 provides a perspective view of a dishwasher appliance, including a dishwasher door according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. In addition, the term "or" is generally intended to be inclusive (i.e., "A or B" is intended to mean "A or B or both"). Furthermore, as used herein, terms of approximation, such as "approximately," "substantially," or "about," refer to being within a ten percent margin of error.

Figure 2:
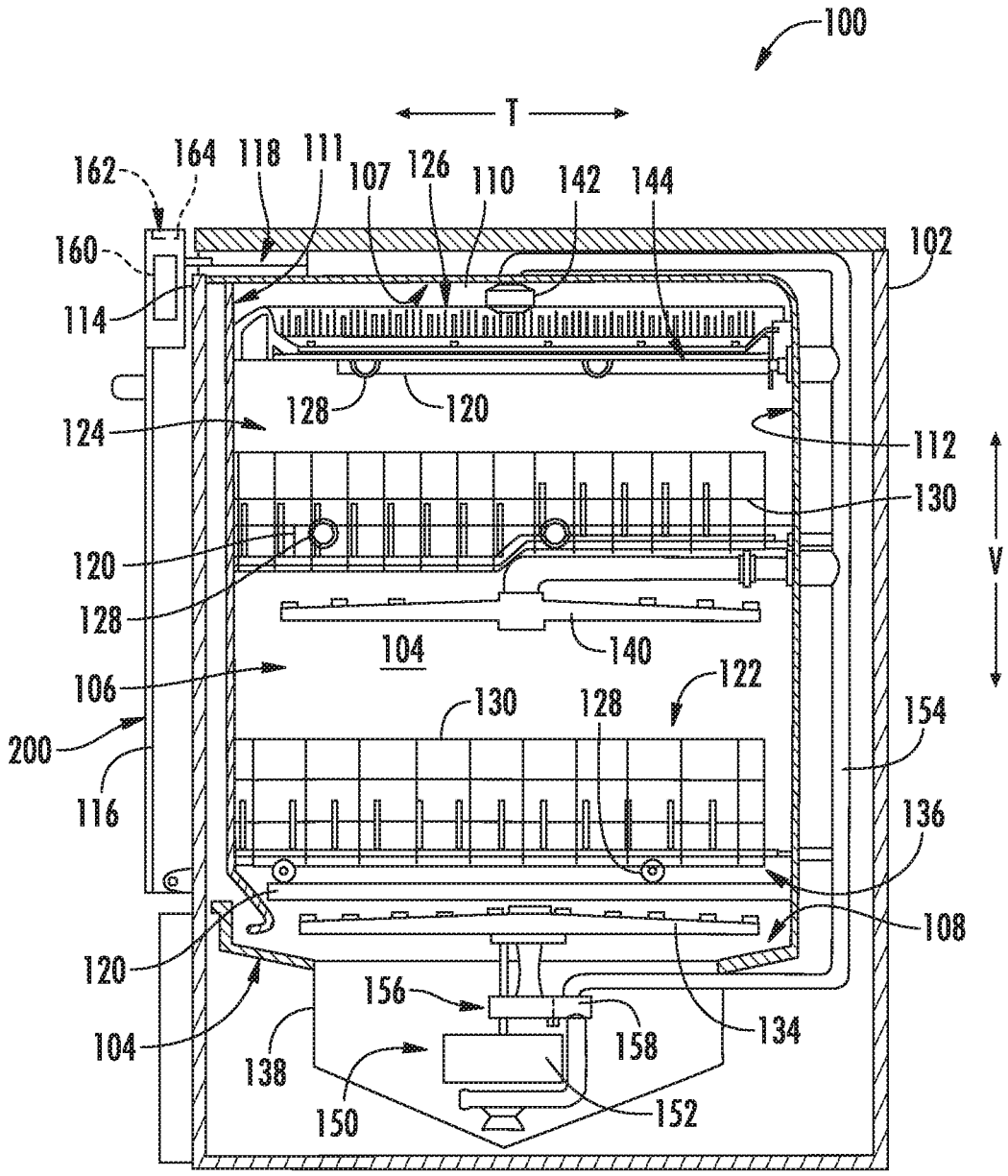
FIG. 2 provides a cross-sectional side view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 having a tub 104 therein that defines a wash chamber 106. As shown, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually orthogonal to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As illustrated in FIG. 2, tub side walls 110 may accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to another exemplary embodiment, a silverware basket (not shown) may be removably attached to a rack assembly (e.g., lower rack assembly 122) for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water or wash fluid (e.g., detergent, water, or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies (e.g., to mid-level spray arm assembly 140 and upper spray assembly 142). However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156 (e.g., which may be positioned within sump 138 of dishwasher appliance 100). Diverter assembly 156 may include a diverter disk (not shown) disposed within a diverter chamber 158 for selectively distributing the wash fluid to the spray arm assemblies 134, 140, 142 or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level or upper spray assemblies 140, 142 (e.g., such as primary supply conduit 154).

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116, as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel 164 through which a user may select various operational features and modes and monitor progress of the dishwasher 100. In one embodiment, the user interface 164 may represent a general purpose I/O ("GPIO") device or functional block. In certain embodiments, the user interface 164 includes input components 166, such as one or more of a variety of electrical, mechanical or electro-mechanical input devices including rotary dials, push buttons, and touch pads. The user interface 164 may further include one or more display components 168, such as a digital display device or one or more indicator light assemblies designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter. Moreover, aspects of the present subject matter may be applied to other appliances as well, such as refrigerators, ovens, microwaves, etc.

Referring now generally to FIGS. 3 through 6, a door assembly 200 will be described according to exemplary embodiments of the present subject matter. For example, door assembly 200 may be used as door 116 of dishwashing appliance 100. Alternatively, door assembly 200 may be used on any other suitable residential or commercial appliance. As described herein, door assembly 200 may share a coordinate system with dishwashing appliance 100, e.g., when door assembly 200 is in the closed position (e.g., as shown in FIG. 2). Specifically, door assembly 200 may define a vertical direction V, a lateral direction L, and a transverse direction T. Therefore, these directions will also be used herein to refer to features of door assembly 200 and its various components and sub-assemblies. Referring briefly again to FIGS. 1 and 2, in the normally closed position, door assembly 200 (illustrated for example as door 116) extends from a top end 202 to a bottom end 204 along the vertical direction V; from a front end 206 to a rear end 208 along the transverse direction T; and between two lateral ends 210 along the lateral direction L.

As explained in more detail below, door assembly 200 is an automated door assembly that automatically opens and closes without manual intervention by a user. In this regard, door assembly 200 may be actuated by a user or by controller 160, e.g., based on a voice command or the press of a button by the user, and may facilitate hands-free opening and closing operations for providing selective access to wash chamber 106. Although door assembly 200 is described herein is being used with dishwasher 100, it should be appreciated that aspects of the present subject matter may be used to automate the door opening and closing operations of any other suitable appliance.

As shown generally in FIGS. 3 through 6, door assembly 200 includes a door frame 220 that is pivotally mounted to cabinet 102, e.g., at front 111 of cabinet 102 over an opening 114 to wash chamber 106. According to the illustrated embodiment, door frame 220 is pivotally mounted at a bottom 108 of cabinet 102 and pivots about a hinge axis 222 that extends substantially along the transverse direction T. Door assembly 200 further includes an extension arm 224 that is mounted to door frame 220 and extends away from door frame 220. More particularly, extension arm 224 is rigidly fixed to door frame 220 a location remote from hinge axis 222 and extends toward a distal end 226 (e.g., substantially along the transverse direction T when door frame 220 is closed).

More specifically, as shown, extension arm 224 extends from door frame 220 at an extension angle 228. According to the illustrated embodiment, extension angle 228 is approximately 90°, which may be particularly suitable for permitting door frame 220 to rotate a full 90° without interference between extension arm 224 and other components of dishwasher 100. However, other suitable extension angles 228 are possible and within the scope of the present subject matter. For example, extension angle 228 may be between about 50 and 130°, between about 70 and 110°, between about 80 and 100°. In addition, although a single extension arm 224 is illustrated, it should be appreciated that door assembly 200 could alternatively include two or more extension arms 224 drive by the same or different actuators.

In general, the opening operation and closing operation of door assembly 200 involves manipulation of extension arm 224. In this regard, door assembly 200 includes a motor 240 that is operably coupled to extension arm 224 for moving door frame 220 between an open position (e.g., where door frame 220 extends within a plane defined by the lateral direction L and the transverse direction T) and a closed position (e.g., where door frame 220 extends within a plane defined by the lateral direction L and the vertical direction V). According to the illustrated embodiment, motor 240 is mounted at a rear 112 of cabinet 102, e.g., on a standoff arm 242 positioned below tub 104. In addition, motor 240 may define an axis of rotation 244 that extends substantially along the transverse direction T, e.g., parallel to hinge axis 222 of door frame 220.

As used herein, "motor" may refer to any suitable drive motor and/or transmission assembly for rotating door assembly 200, or more particularly, door frame 220. For example, motor 240 may be a brushless DC electric motor, a stepper motor, or any other suitable type or configuration of motor. For example, motor 240 may be an AC motor, an induction motor, a permanent magnet synchronous motor, or any other suitable type of AC motor. In addition, motor 240 may include any suitable transmission assemblies, clutch mechanisms, or other components. According to an exemplary embodiment, motor 240 may be operably coupled to controller 160, which is programmed to rotate door frame 220 according to predetermined operating cycles, based on user inputs (e.g. via touch buttons 166), based on input from a remote device, etc.

According to exemplary embodiments, door assembly 200 further includes a drive pulley 250 which is rotatably coupled to motor 240. In addition, a cable 252 is wrapped around drive pulley 250 and is connected to distal end 226 of extension arm 224. In this manner, motor 240 may be configured for rotating to wind cable 252 around pulley to move door frame 220 toward the closed position and may unwind cable 252 to move door frame 220 toward the open position. Notably, in order to prevent out-of-plane forces on extension arm 224, axis of rotation 244 is illustrated herein is being perpendicular to a plane defined by extension arm 224 (e.g., a plane defined by the vertical direction V in the transverse direction T). In addition, drive pulley 250 may be positioned in the same transverse plane as extension arm 224.

Figure 3:
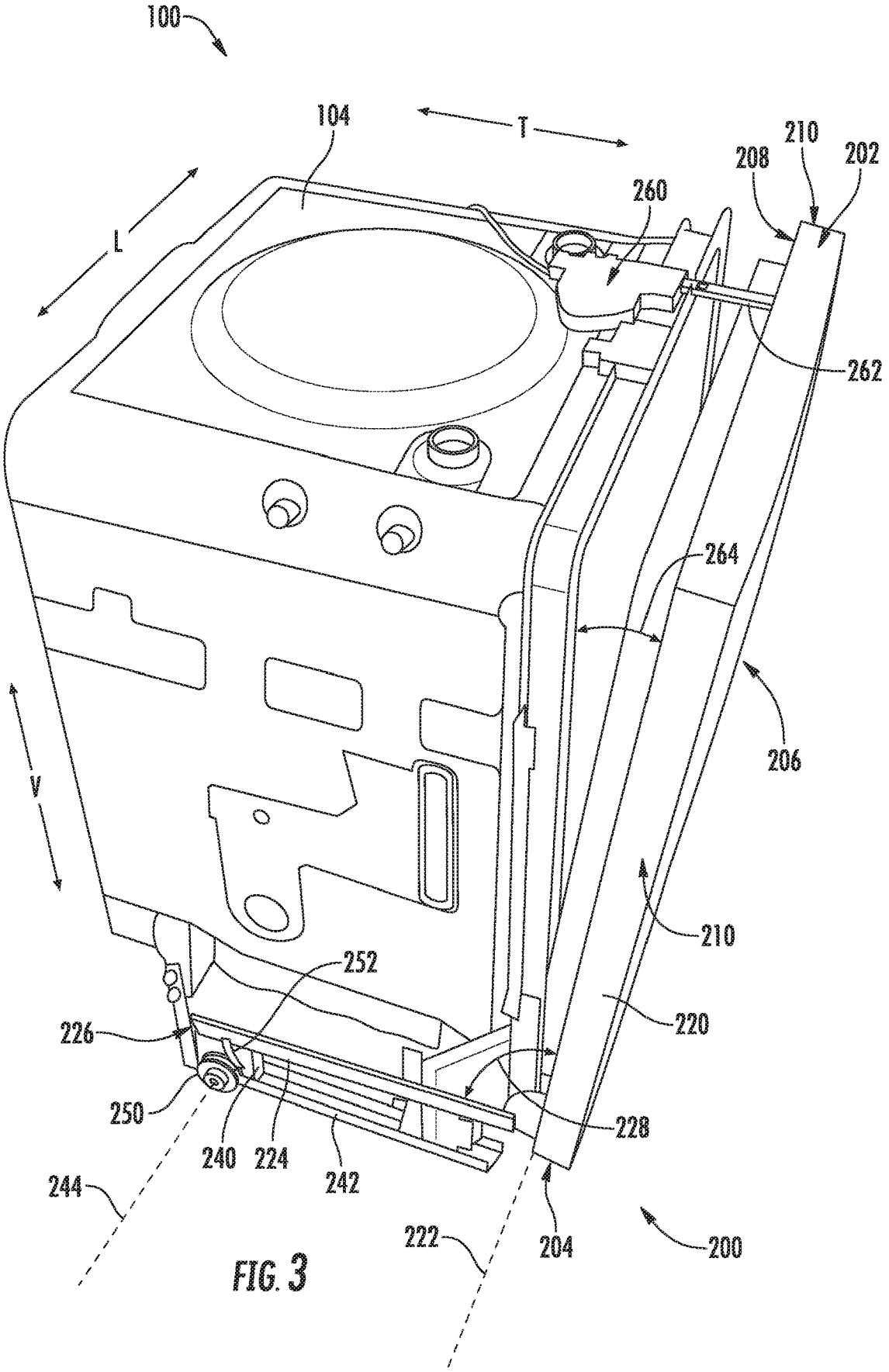
FIG. 3 provides a perspective view of a dishwasher appliance, including an automated door assembly according to exemplary embodiments of the present disclosure.
Figure 4:
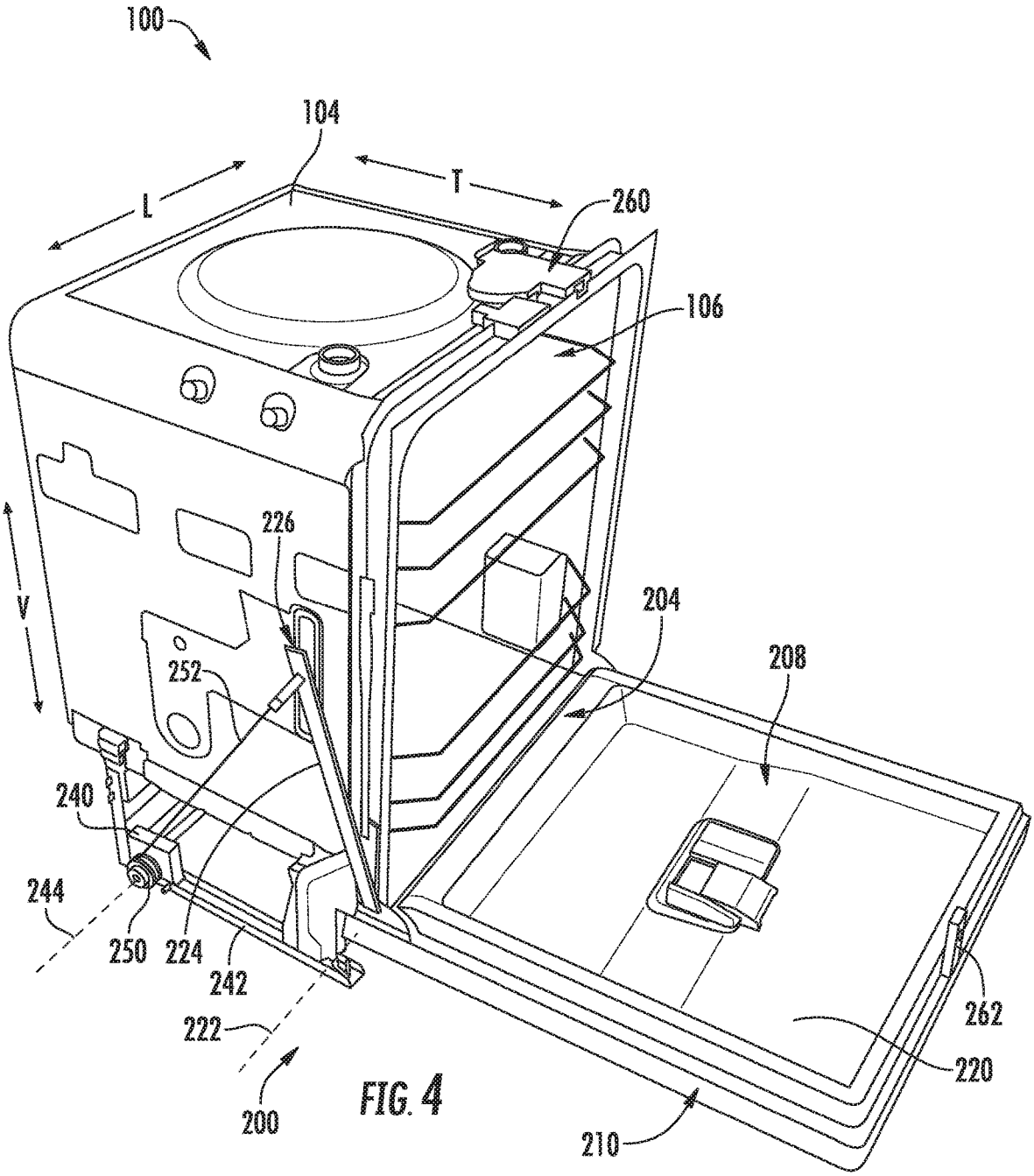
FIG. 4 provides a perspective view of the exemplary dishwasher appliance of FIG. 3 with the automated door assembly in the open position.
Figure 5:
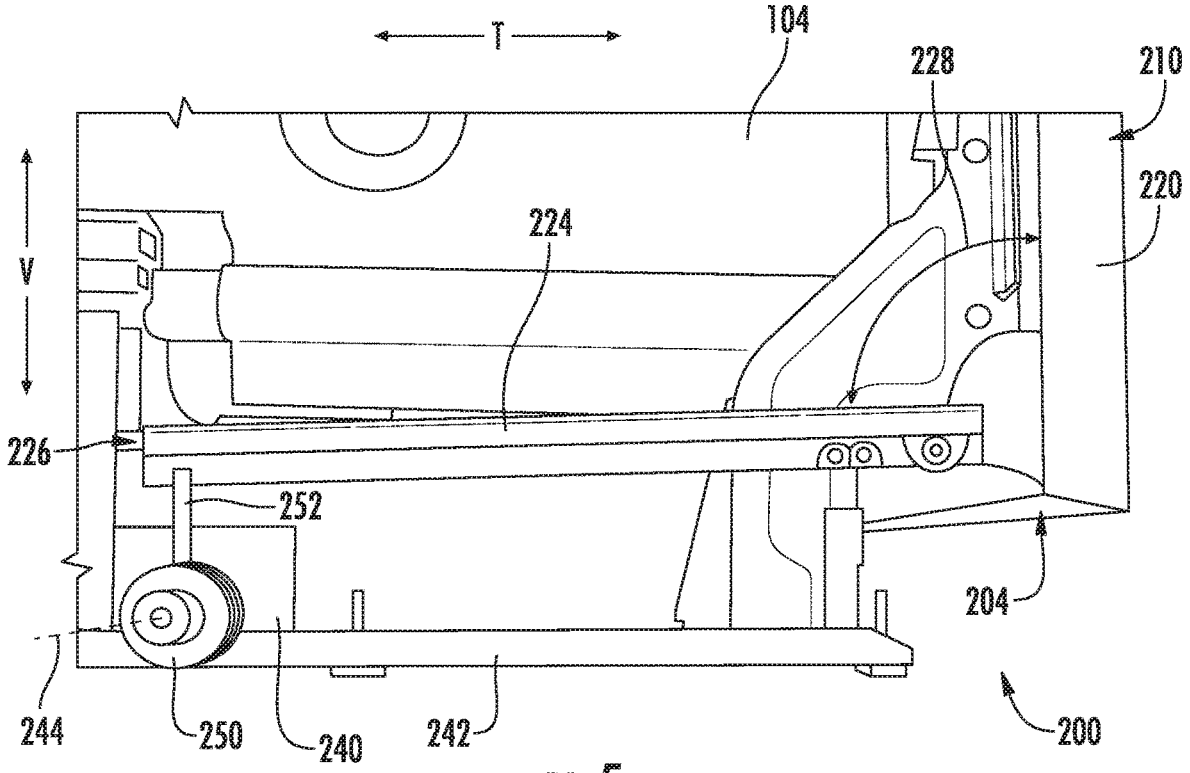
FIG. 5 provides a side view of the exemplary dishwasher appliance and the exemplary automated door assembly of FIG. 3 according to an exemplary embodiment of the present subject matter.
Figure 6:
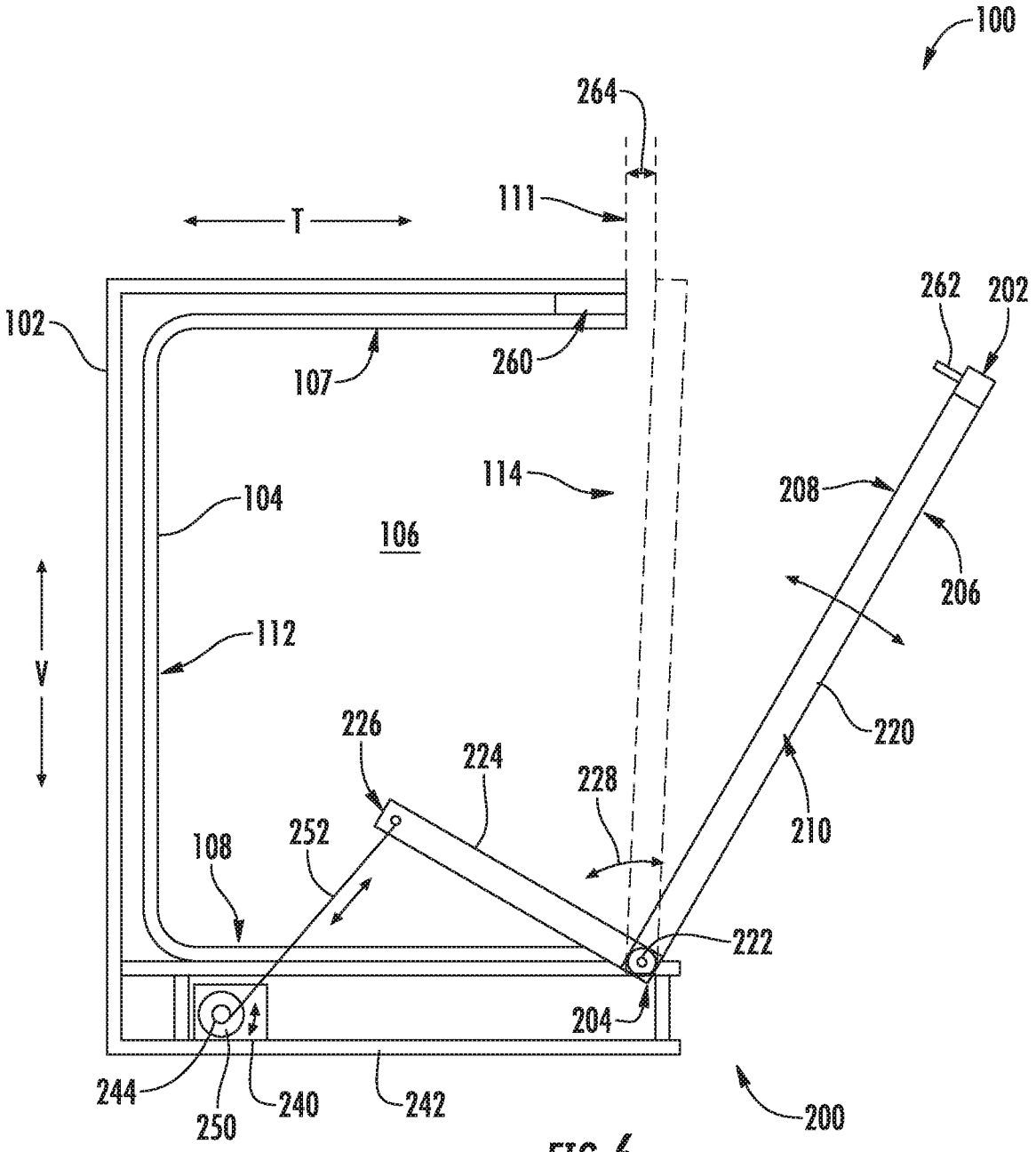
FIG. 6 provides a schematic view of the automated door assembly of FIG. 3 according to an exemplary embodiment of the present subject matter.

As best shown in FIGS. 3, 4, and 6, door assembly 200 further includes a latch assembly 260 that is generally configured for engaging door frame 220 as door frame 220 approaches or is near the closed position. In this regard, as best shown in FIG. 6, door frame 220 may include a striker 262 that is mounted to a top end of door frame 220 and is configured for engaging latch assembly 260 when door frame 220 reaches or is within an engagement angle 264 relative to the closed position. In other words, when door frame 220 is moving toward the closed position, striker 262 first contacts latch assembly 260 when door frame 220 reaches extension angle 264 relative to a plane defined by the vertical direction V and the lateral direction L. As shown, latch assembly 260 is positioned on a top of tub 104 and is configured to slowly receiving and latching door frame 220 in the closed position as it pivots toward the closed position. Furthermore, latch assembly 260 may be configured for initiating a "slow-close" operation of door frame 220.

By contrast, when door frame 220 is in the closed position and the opening operation is initiated, latch assembly 260 may push striker 262 and door frame 220 toward the open position until latch assembly 260 engagement angle 264, wherein latch assembly 260 disengages striker 262 to permit door frame 220 to fall toward the open position. In this regard, by using latch assembly 260 to push door frame 220 away from a vertical orientation, the force of gravity may facilitate the door opening process. It should be appreciated that engagement angle 264 may vary while remaining within the scope of the present subject matter. For example, engagement angle 264 may be between about 1° and 20°, between about 2° and 10°, between about 3° and 7°, or about 5° relative to the vertical direction V. By pushing door frame 220 to the engagement angle 264, gravity acting on a center mass of door frame 220 will generate a torque or force about hinge axis 222 that causes door frame 220 to rotate or move toward the open position.

As explained above, door assembly 200 may be operated using a controller, such as a dedicated controller or dishwasher controller 160. In this regard, controller 160 may be in operative communication with motor 240 and latch assembly 260. Furthermore, controller 160 may be configured for performing an opening operation when a command is received to open door assembly 200 and a closing operation when a command is received to close door assembly 200. Exemplary opening and closing operations are described below. However, it should be appreciated that controller 160 may alternatively be configured for moving door assembly 200 in any other suitable manner. For example, automated door assembly 200 may be configured for periodically opening and closing to release steam within wash chamber 106, to permit the user add more dish detergent or food utensils, etc.

According to an exemplary embodiment, the opening operation includes, upon receiving a command to open door frame 220, actuating latch assembly 260 to push striker 262 and door frame 220 away from a front of cabinet 102, e.g., toward the engagement angle 264 that permits gravity to urge door frame 220 toward the open position. Simultaneously, or subsequently, controller 160 may operate motor 240 to slowly unwind cable 252 to permit door frame 220 to slowly and controllably rotate to the open position. By contrast, the closing operation may include operating motor 240 to wind cable 252 and rotate door frame 220 toward the closed position. Once door frame 220 reaches engagement angle 264, latch assembly 260 may be actuated to slowly pull door frame 220 into the closed position.

In addition, referring again to FIG. 1, dishwasher 100 may generally include an external communication system 270 which is configured for enabling the user to interact with dishwasher 100 using a remote device 272. Specifically, according to an exemplary embodiment, external communication system 270 is configured for enabling communication between a user, an appliance, and a remote server or network 274. According to exemplary embodiments, dishwasher 100 may communicate with a remote device 272 either directly (e.g., through a local area network (LAN), Wi-Fi, Bluetooth, etc.) or indirectly (e.g., via a network 274), as well as with a remote server (not shown), e.g., to receive notifications, provide confirmations, input operational data, etc.

In general, remote device 272 may be any suitable device for providing and/or receiving communications or commands from a user. In this regard, remote device 272 may include, for example, a personal phone, a tablet, a laptop computer, or another mobile device. In addition, or alternatively, communication between the appliance and the user may be achieved directly through an appliance control panel (e.g., control panel 162).

In general, network 274 can be any type of communication network. For example, network 274 can include one or more of a wireless network, a wired network, a personal area network, a local area network, a wide area network, the internet, a cellular network, etc. In general, communication with network may use any of a variety of communication protocols (e.g., TCP/IP, HTTP, SMTP, FTP), encodings or formats (e.g. HTML, XML), and/or protection schemes (e.g., VPN, secure HTTP, SSL).

External communication system 270 is described herein according to an exemplary embodiment of the present subject matter. However, it should be appreciated that the exemplary functions and configurations of external communication system 270 provided herein are used only as examples to facilitate description of aspects of the present subject matter. System configurations may vary, other communication devices may be used to communicate directly or indirectly with one or more appliances, other communication protocols and steps may be implemented, etc. These variations and modifications are contemplated as within the scope of the present subject matter.

As one skilled in the art will appreciate, the above described embodiments are used only for the purpose of explanation. Modifications and variations may be applied, other configurations may be used, and the resulting configurations may remain within the scope of the invention. For example, door assembly 210 may have different or additional components, extension arm 224 may be coupled to any other suitable actuator having any other suitable position, etc. One skilled in the art will appreciate that such modifications and variations may remain within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical, a lateral, and a transverse direction, the dishwasher appliance comprising:

a cabinet;

a tub positioned within the cabinet, the tub defining a wash chamber for receipt of articles for washing;

a door assembly for providing selective access to the wash chamber, the door assembly comprising:

a door frame pivotally mounted to the cabinet;

an extension arm mounted to a bottom of the door frame and extending away from the door frame;

a motor mounted proximate a bottom of the cabinet and comprising a drive pulley rotatably coupled to the motor;

a cable wrapped around the drive pulley and being connected to a distal end of the extension arm, wherein the motor is configured for controllably rotating the door frame toward a closed position by winding the cable and toward an open position by unwinding the cable;

a latch assembly configured for engaging the door frame as the door frame approaches the closed position; and a striker mounted to the door frame, wherein the latch assembly engages the striker when the door frame is positioned at an engagement angle relative to the closed position, and wherein a controller is configured for performing a closing operation comprising operating the motor to wind the cable and rotate the door frame toward the closed position and actuating the latch assembly when the door frame reaches the engagement angle to pull the door frame to the closed position.

2. The dishwasher appliance of claim 1, wherein extension arm defines an extension angle relative to the door frame, the extension angle being between about 70 and 110 degrees.

3. The dishwasher appliance of claim 2, wherein the extension angle is approximately 90 degrees.

4. The dishwasher appliance of claim 1, wherein an axis of rotation of the motor extends perpendicular to a plane defined by the extension arm.

5. The dishwasher appliance of claim 4, wherein the door frame is pivotally mounted to a bottom of the cabinet and pivots about a hinge axis that extends substantially parallel to the axis of rotation of the motor.

6. The dishwasher appliance of claim 1, wherein the motor is mounted below the tub proximate a back side of the cabinet.

7. The dishwasher appliance of claim 1, wherein the controller is further configured for performing an opening operation, the opening operation comprising:

actuating the latch assembly to push the door frame to the engagement angle that permits gravity to urge the door frame toward the open position; and operating the motor to unwind the cable and permit the door frame to rotate to the open position.

8. The dishwasher appliance of claim 1, wherein the controller is in operative communication with a remote device, the remote device being configured for initiating the opening operation and the closing operation.

9. The dishwasher appliance of claim 1, wherein the engagement angle is between about 2 and 10 degrees.

10. The dishwasher appliance of claim 1, wherein the engagement angle is approximately 5 degrees.

11. The dishwasher appliance of claim 1, wherein the door frame is rotatable about a hinge axis and the extension arm is mounted to the door frame at a location remote from the hinge axis.

12. An automated door assembly for a dishwasher appliance, the dishwasher appliance comprising a tub positioned within a cabinet and defining a wash chamber, the automated door assembly comprising:

a door frame pivotally mounted to the cabinet;

an extension arm mounted to a bottom of the door frame and extending away from the door frame;

a motor mounted within the cabinet proximate a bottom of the cabinet for selectively rotating a drive pulley;

a cable wrapped around the drive pulley and being connected to a distal end of the extension arm, wherein the motor is configured for controllably rotating the door frame toward a closed position by winding the cable and toward an open position by unwinding the cable;

a latch assembly configured for engaging the door frame as the door frame approaches the closed position; and a striker mounted to the door frame, wherein the latch assembly engages the striker when the door frame is positioned at an engagement angle relative to the closed position, and wherein a controller is configured for performing a closing operation comprising operating the motor to wind the cable and rotate the door frame toward the closed position and actuating the latch assembly when the door frame reaches the engagement angle to pull the door frame to the closed position.

13. The automated door assembly of claim 12, further comprising a controller in operative communication with the motor and the latch assembly, the controller being configured for performing an opening operation, the opening operation comprising:

actuating the latch assembly to push the door frame to the engagement angle that permits gravity to urge the door frame toward the open position; and operating the motor to unwind the cable and permit the door frame to rotate to the open position.

14. A dishwasher appliance defining a vertical, a lateral, and a transverse direction, the dishwasher appliance comprising:

a cabinet;

a tub positioned within the cabinet, the tub defining a wash chamber for receipt of articles for washing;

a door assembly for providing selective access to the wash chamber, the door assembly comprising:

a door frame pivotally mounted to the cabinet;

an extension arm mounted to and extending away from the door frame;

a motor operably coupled to the extension arm for moving the door frame between an open position and a closed position;

a latch assembly configured for engaging the door frame as the door frame approaches the closed position; and a controller in operative communication with the motor and the latch assembly, the controller being configured for performing an opening operation comprising actuating the latch assembly to push the door frame toward the open position to permit gravity to urge the door frame toward the open position and operating the motor to unwind a cable and permit the door frame to rotate to the open position, the controller being further configured for performing a closing operation comprising operating the motor to wind the cable and rotate the door frame toward the closed position and actuating the latch assembly to pull the door frame to the closed position.

* * * * *